United States Patent [19]

Josephson

[11] 4,355,567

[45] Oct. 26, 1982

[54] PIVOTED BLADE DAMPER AND PIN

[75] Inventor: Louis Josephson, Yonkers, N.Y.

[73] Assignee: American Hardware & Paint Co., Inc., Elizabeth, N.J.

[21] Appl. No.: 125,675

[22] Filed: Feb. 28, 1980

[51] Int. Cl.[3] ..... F24F 13/14

[52] U.S. Cl. ..... 98/121 A; 16/270; 49/403; 98/110; 126/285 R; 403/104; 403/388

[58] Field of Search ..... 98/107, 110, 121 A; 251/304, 308; 49/403; 403/388, 104; 16/130, 131, 270, 254, 249; 292/149, 345; 411/187, 188, 369, 542; 126/285 R, 288, 289, 291

[56] References Cited

U.S. PATENT DOCUMENTS

| | | | |
|---|---|---|---|
| 240,387 | 4/1881 | Cowdy | 411/187 X |
| 493,363 | 3/1893 | Lang | 126/292 |
| 2,146,142 | 2/1939 | Heasky | 126/285 R |
| 2,183,292 | 12/1939 | Kerentoff | 126/292 |
| 2,396,005 | 3/1946 | Gross et al. | 411/369 X |
| 3,156,446 | 11/1964 | Chaloka | 98/110 X |
| 3,260,018 | 7/1966 | Schuh | 292/345 X |
| 3,487,768 | 1/1970 | Watson | 98/110 X |
| 3,718,081 | 2/1973 | Root | 98/121 A X |

FOREIGN PATENT DOCUMENTS

| | | | |
|---|---|---|---|
| 365330 | 12/1922 | Fed. Rep. of Germany | 251/308 |
| 512208 | 1/1955 | Italy | 403/388 |

*Primary Examiner*—Albert J. Makay
*Assistant Examiner*—Harold Joyce
*Attorney, Agent, or Firm*—Dressler, Goldsmith, Shore, Sutker & Milnamow, Ltd.

[57] ABSTRACT

A mounting pin for a pivoted damper blade is disclosed which comprises a cylindrical shaft having a cenrtrally positioned hole extending therethrough, this hole being surrounded on one side of the pin with an upstanding flat seat. This hole is longer than it is wide so that it extends longitudinally of the pin. Also, the pin at one side of the seat is formed to include longitudinal depressions which provide a plurality of circumferentially spaced arc segments which form an interrupted circle. This pin is mounted on a blade at a side margin thereof by means of a bolt extending through a hole in the blade and through the hole in the pin, and a nut is associated with the bolt, the nut locking against the flat seat of the pin. A resilient gasket is interposed between the head of the bolt and the rear face of the blade so that the bolt need not be held while the nut is tightened. Also, a locking washer is desirably interposed between the nut and the seat.

6 Claims, 6 Drawing Figures

FIG. 1
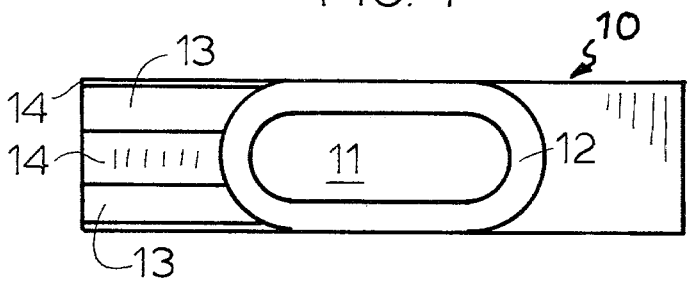
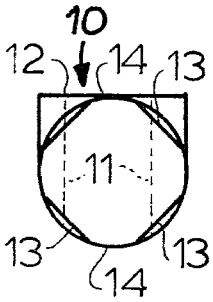
FIG. 3
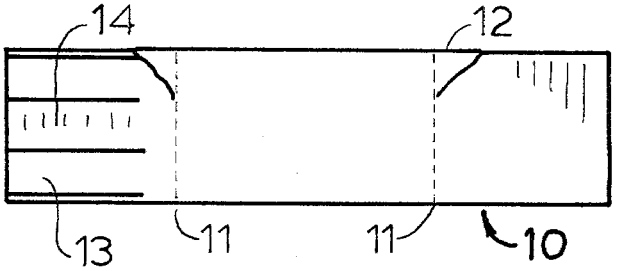
FIG. 2
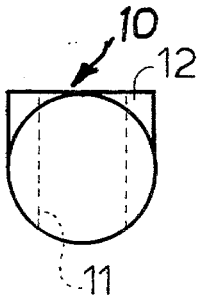
FIG. 4
FIG. 5
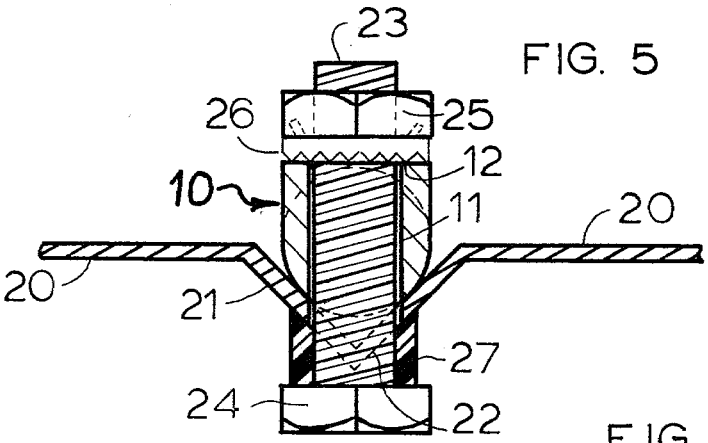
FIG. 6
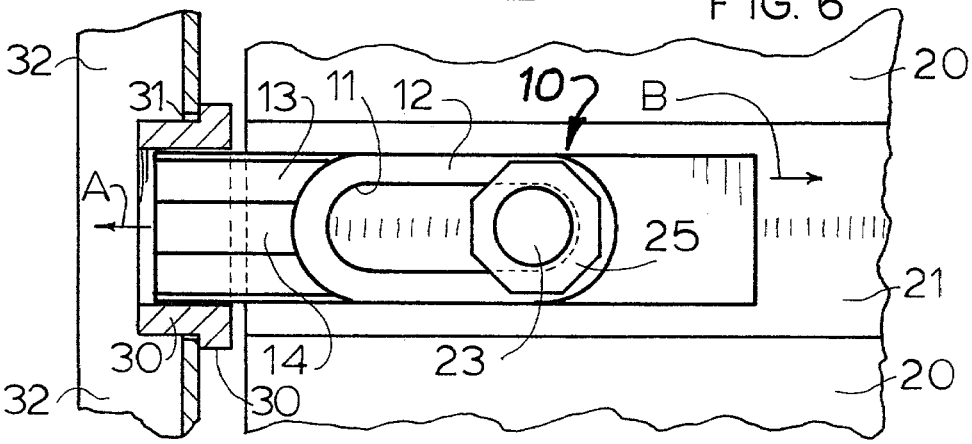

PIVOTED BLADE DAMPER AND PIN

DESCRIPTION

1. Technical Field

This invention relates to pivoted blade dampers, to the combination of blade and mounting pins which is inserted into the damper frame, and to the pins which are used in the combination.

2. Background Art

Pivoted blade dampers are well known and in common use, but considerable difficulty has been encountered in the effort to find a construction which would be easy to build, reliable to operate, and easy to service.

The traditional construction has involved the use of a blade which is bent in the middle to receive the pins which are used to rotatably mount the blade in the damper frame. In the conventional construction, two straps are secured to the blade over the central bend therein, one at each end of the blade. These straps must be accurately positioned so that the set screws which are used to hold the pins in place will bear upon the center of the pins. Otherwise, the securement of the pins will be inadequate.

After the straps are mounted on the blade, the two pins are inserted under the straps and are loosely positioned within the lateral confines of the blade so that the assembly can be inserted between the side walls of the frame. The set screws are then tightened and the installation inspected. If the screw is too tight, the blade is deformed. If the screw is too loose, the pin can work its way loose and the blade will wobble which may cause the blade to bind and the supporting bushing to wear excessively.

It must also be appreciated that the set screw is held in place only by the threads which are tapped in the strap, and these may be poorly formed and give way.

As a result the structure is expensive and of only limited reliability.

In order to avoid these difficulties which have plagued the damper industry for at least the last 30–40 years, some damper manufacturers have modified the construction in two different ways. First, the pins have been welded directly to the blades, but then the blades are permanently associated with the frame. In shipment a blade may be damaged, and this creates all sorts of problems because there is little capacity to remove the defective blade and to install a new one. The situation is even more difficult after installation since there is no way to service a blade or to replace a worn bushing.

In order to maintain serviceability, some of the pins have had a hole drilled in them (which is expensive and difficult), and a nut and bolt is used to directly attach the pin to a pin-receiving depression in the blade. This expedient eliminates straps and the blade distortion and other deficiencies in the strap construction described earlier, but it introduces other problems which will now be described.

In assembling dampers using straps, one person can do the job. However, when assembling a damper using a pin with a hole in it, two persons are required. These two persons will normally cooperate by having one positioned at each side of the damper. Two persons are needed because the pins, the nuts and the bolts must all be put in place while the blade is held in proper position between the sides of the damper frame. This adds greatly to the cost of assembling the damper, and it is especially difficult to remove and reinstall blades in a damper which is allready in place.

As a matter of interest, spring mounted retractable pins have been employed on light weight single blade dampers, but the spring mounting introduces a loosness and wobble into the pin mounting which prevents the use of this construction in heavier and multiblade structures.

DISCLOSURE OF INVENTION

In accordance with this invention, a mounting pin for a pivoted damper blade is provided having a centrally located hole extending therethrough and which is surrounded on one side of the pin with an upstanding flat seat. In this way the pin at one side is adapted to be snugly received in a pin-receiving depression in a pivoted blade, and on the other side a nut can lock against the flat seat which surrounds the hole at one side. A toothed washer is preferably interposed between the nut and the to further insure a secure hold. It is particularly desirable to employ a "Kep" nut in which the rotatable toothed washer is attached to the nut.

A feature of this invention is to form the pin at one side of the seat to include longitudinal depressions which provide a plurality of circumferentially spaced arc segments which form an interrupted circle. This reduces friction within the supporting bushings and air pressure within the duct will blow out any particles which may accumulate between the pin and the bushing. Such particles can cause the bushing to wear or cause the multiblade damper to bind.

A feature of particular importance is the fact that the hole in the pin extends longitudinally of the pin so that the pin can be shifted longitudinally after a bolt is projected through a hole in the blade and through the hole in the pin. In this way the nut can be loosely installed (finger tight) with the pins retracted. The blade with the retracted pins can then be positioned between the sides of the damper frame and the pins can be projected to mount the blade. Thereafter, the nut can be tightened for long term securement.

If it is desired to remove the blade, the nuts can be loosened, the pins can be retracted, and the blade easily removed for servicing. The bushings can then be removed and replaced and any other maintenance accomplished. Reinstallation is equally easy since the blades can be inserted with the pins in the retracted position and the pins can be projected while the blade is held in place.

Still another feature of this invention is the use of a resilient washer between the head of the bolt and the rear of the damper blade. This seals the hole in the blade and it also prevents the bolt from turning so that the nut can be tightened without grasping the head of the bolt (as with a wrench). This is enabled because when slight pressure is applied to the nut, the resilient washer is compressed against the convex rear surface of the blade so that it cannot turn, and the bolt head freezes to the immobile resilient washer.

BRIEF DESCRIPTION OF DRAWINGS

The invention is illustrated in the accompanying drawings in which:

FIG. 1 is a top plan view of a mounting pin constructed in accordance with the invention;

FIG. 2 is a side elevation of the mounting pin of FIG. 1;

FIG. 3 is an end view looking at the end of the pin which it is intended to project into the mounting bushing;

FIG. 4 is an end view looking at the end of the pin which it is intended to seat in the pin-receiving depression of the blade;

FIG. 5 is a partial sectional view showing the pin of FIGS. 1–4 mounted on a blade; and FIG. 6 is a partial sectional view taken through the damper frame and showing the way in which a blade with its associated slideable mounting pin is mounted in a bushing held by the frame.

Referring more particularly to the drawings, FIGS. 1 and 2 show the mounting pin 10 which is preferably formed by die casting of a zinc-based corrosion-resistant alloy, such as Zamac. However, the composition of the pin is not crucial to this invention, and the pin might even be made of plastic.

The pin 10 is cylindrical in cross-section, and it includes a centrally positioned hole 11 which extends through the pin from one side to the other. The hole 11 is surrounded at one side of the pin by a flat seat 12.

At one side of the seat 11, the pin is formed with longitudinal depressions 13 which provide a plurality of circumferentially spaced arc segments 14.

As a matter of interest, while it is desired that the end of the pin with the arc segments 14 be inserted within a supporting bushing to minimize friction and binding tendencies, the pin can be turned around by one who does not wish to use this feature of the invention. This may be preferred for weighted blades, though these are unusual.

Referring to FIG. 5, blade 20 is formed with a pin-receiving depression which is the V-bend 21 in the form shown, though some manufacturers use other shapes. A hole 22 is punched or drilled in blade 20 at the crown of the V-bend and the shaft 23 of the bolt 24 is extended through the hole 22 and then through hole 11 in pin 10. Nut 25 with its associated rotatable toothed washer 26 is screwed onto the end of threaded shaft 23. As can be seen, nut 25 locks against the seat 12, preferably with the aid of some form of lock washer 26.

In order to seal hole 22 and to enable nut 25 to be screwed on without using a wrench on the head of bolt 24, a resilient washer 27 is interposed between the head of bolt 24 and the rear face of the blade 20. The distortion of washer 27 which prevents its rotation can be seen in FIG. 5.

As will be evident, the blade 20 is not distorted as was commonly encountered using the prior conventional strap method.

The combination of blade and mounting pin (two are used) shown in FIG. 5 is then installed in the opposed bushings (one is shown) mounted in the sides of the damper frame as shown in FIG. 6.

In FIG. 6, the pin 10 is seen from the top with blade 20 in its closed poisition. The pin 11 is shown in its projected position in which it has been moved longitudinally as shown by arrow A. In this projected position, the end of the pin which is formed with arc sections 14 extends into bushing 30 which is mounted in hole 31 in the side of frame 32. Nut 25 and the associated shaft 23 of the bolt are shown at one end of the hole 11. If removal of blade 20 is desired, then the pin 10 is moved as shown by arrow B. Of course, there are two pins, and both are moved.

The shape of hole 11 and its significance should now be apparent. With the length of the hole greater than its width, the bolt can be securely positioned within the hole 11 even though the pin can be slid longitudinally along the depression 21.

It will be observed that a bolt and nut are shown and are preferably used. However, it is possible to use self-drilling screws, such as the "Tek" fastener, or other pin-type fasteners, though these are not preferred because a nut and bolt has greater holding power and can be released when desired.

I claim:

1. In combination a pivoted blade having a mounting pin comprising a cylindrical shaft having a centrally positioned hole extending therethrough, said hole being surrounded on one side of the pin with an upstanding flat seat, and said hole being longer than it is wide so that it extends longitudinally of the pin, said mounting pin being mounted at a side margin of said blade in a pin-receiving depression in said blade by means of a bolt extending through a hole in said blade and through the longitudinally extending hole in said pin, and a nut associated with said bolt, said nut locking against the flat seat of said pin.

2. A combination as recited in claim 1 in which a resilient gasket is interposed between the head of the bolt and the rear face of the blade.

3. A combination as recited in claim 1 in which a locking washer is interposed between said nut and said seat.

4. A combination as recited in claim 1 in which said nut is a "Kep" nut.

5. A combination as recited in claim 1 in which one side of said pin extends beyond the side margin of said blade and is formed to include longitudinal depressions which provide a plurality of circumferentially spaced arc segments which form an interrupted circle.

6. A combination as recited in claim 1 in which said pin is die cast.

* * * * *